US005902146A

United States Patent [19]

Hanami

[11] Patent Number: 5,902,146

[45] Date of Patent: May 11, 1999

[54] MODULAR PLUG GUIDE PLATE

[75] Inventor: Chiyoki Hanami, Tokyo, Japan

[73] Assignee: Hirose Electric Co., Ltd., Tokyo, Japan

[21] Appl. No.: 08/867,533

[22] Filed: Jun. 2, 1997

[30] Foreign Application Priority Data

Jul. 10, 1996 [JP] Japan ..... 8-198568

[51] Int. Cl.[6] ..... H01R 4/24

[52] U.S. Cl. ..... 439/405

[58] Field of Search ..... 439/404, 405, 439/418, 397, 498, 499

[56] References Cited

U.S. PATENT DOCUMENTS 4,143,935 3/1979 Goodman et al. ..... 439/405
5,498,172 3/1996 Noda ..... 439/404

FOREIGN PATENT DOCUMENTS 5824908 5/1983 Japan .

*Primary Examiner*—Gary Paumen
*Assistant Examiner*—Antoine Ngandjui
*Attorney, Agent, or Firm*—Kanesaka & Takeuchi

[57] ABSTRACT

An electrical connector includes a housing body (1) having a plurality of first arranging grooves (4) for arranging a first row of insulated conductors (C1) of a cable in a plane perpendicular to a plugging direction to a mating connector; an intermediate member (3) having a first surface facing the first row of conductors and second arranging grooves (3D) on a second surface opposite to the first surface for arranging a second row of insulated conductors (C2); a holding member (2) for holding first and second rows of contact elements (5, 6) and having an plug opening (7); a plurality of first press connection sections (5B) extending from the first contact elements at such positions that they cut into core wires of the first row of conductors; a plurality of connection sections (5A, 6A) extending from the first and second contact elements into the plug opening; a plurality of extension sections (6C) extending from the second row of contact elements in parallel to the second row of conductors; and a plurality of second press connection sections (6B) extending from the extension sections for press connection to the second insulated conductors.

3 Claims, 4 Drawing Sheets

MODULAR PLUG GUIDE PLATE

BACKGROUND OF THE INVENTION

1. Field of the Invention

The present invention relates to electrical connectors and, more particularly, to an electrical connector having cables extending in parallel to a circuit board on which a mating connector is mounted.

2. Description of the Related Art

Japanese patent application Kokoku No. 24908/83 discloses a connector having a cable extending in a direction perpendicular to the plugging direction. As shown in FIG. 4, the connector includes a housing body 51 with a raised section 52 and two types of contact elements 53 and 54 arranged in a direction perpendicular to the sheet. The shorter contact elements 54 are arranged in a zigzag fashion in two rows. A pair of frame members 55 are attached to the housing body 51 for enclosing the connection sections 53A and 54A of the contact elements 53 and 54 and defining a receiving cavity 56 for receiving a mating connector. The press connection sections 53B and 54B of the contact elements 53 and 54 have connection slits which are brought into contact with core wires of a cable C when the cable C is press connected to the contact elements 53 and 54.

A cable holder 61 is mounted on the housing body 51. The cable holder 61 has a cavity for receiving the raised section 52 of the housing body 51 Two cable inlets 63 and 64 are formed in the holding member 61 in two planes perpendicular to the contact elements 53 and 54. The cable inlet 63 is formed as grooves in the bottom of the cavity 62 which communicate with slot 63A into which insulated conductors of a cable C (flat or usual cable) are placed, and the other cable inlet 64 is formed as grooves 64 extending in parallel to the cable inlet 63. Guide slots 65 and 66 are formed at right angles with the cable inlets 63 and 64 for guiding the press connection sections 53B and 54B of the contact elements 53 and 54.

Two rows of insulated conductors of a flat cable C are placed in the respective cable inlets 63 and 64 of the cable holder 61. Then, the cable holder 61 is pressed against the housing body 51 such that the press connection sections 53B and 54B of contact elements 53 and 54 are put into the guide slots 65 and 66. The opposed blade portions of the press connection sections 53B and 54B cut the insulation of the conductors and contact the core wires of the cable. Thus, the cable is connected in two tiers thereby increasing the connection density.

However, the height of the cable holder 61 is at least the press connection sections 53B necessary for the two-tier press connection, failing to provide a low profile connector.

The connector having a cable extending at right angles to the plugging direction is connected to a mating connector mounted on a circuit board for example. In some cases, a plurality of circuit boards are mounted in equipment in parallel to each other between which the connector is used. Such an application, the height of the connector must be small.

There is a contact element having a small press connection section. The contact element is made by stamping a metal sheet to provide a press connection section in the form of a triangular blade which cut into the core wire of a cable. Consequently, the press connection section neither cuts through the cable nor projects from the cable to a large extent so that the height of the connector is reduced by that much. However, this connector fails to connect a cable in two tiers .

SUMMARY OF THE INVENTION

Accordingly, it is an object of the invention to provide a low-profile electrical connector capable of connecting a cable in two tiers which extend at right angles to the plugging direction.

According to the invention there is provided an electrical connector includes a housing body having a plurality of first arranging grooves for arranging a first row of insulated conductors of a cable in a plane perpendicular to a plugging direction to a mating connector; an intermediate member having a first surface facing the first row of conductors and second arranging grooves on a second surface opposite to the first surface for arranging a second row of insulated conductors; a holding member for holding first and second rows of contact elements and having an plug opening; a plurality of first press connection sections extending from the first contact elements at such positions that they cut into core wires of the first row of conductors; a plurality of connection sections extending from the first and second contact elements into the plug opening; a plurality of extension sections extending from the second row of contact elements in parallel to the second row of conductors; and a plurality of second press connection sections extending from the extension sections for press connection to the second insulated conductors.

The second press connections sections are provided on the extension sections which extend laterally from a central portion of the second contact elements so that they are positioned close to the first insulated conductors, making it possible to reduce the height of the first contact elements and thus the height of the entire connector The extension sections increase the connector depth but present no problem because there are insulated conductors anyway.

The receiving grooves are provided in the intermediate member so as to permit the second row of insulated conductors to be placed closer to the first row of insulated conductors, making it possible to further reduce the height of the contact elements.

DESCRIPTION OF THE PREFERRED EMBODIMENT

Figure 1:
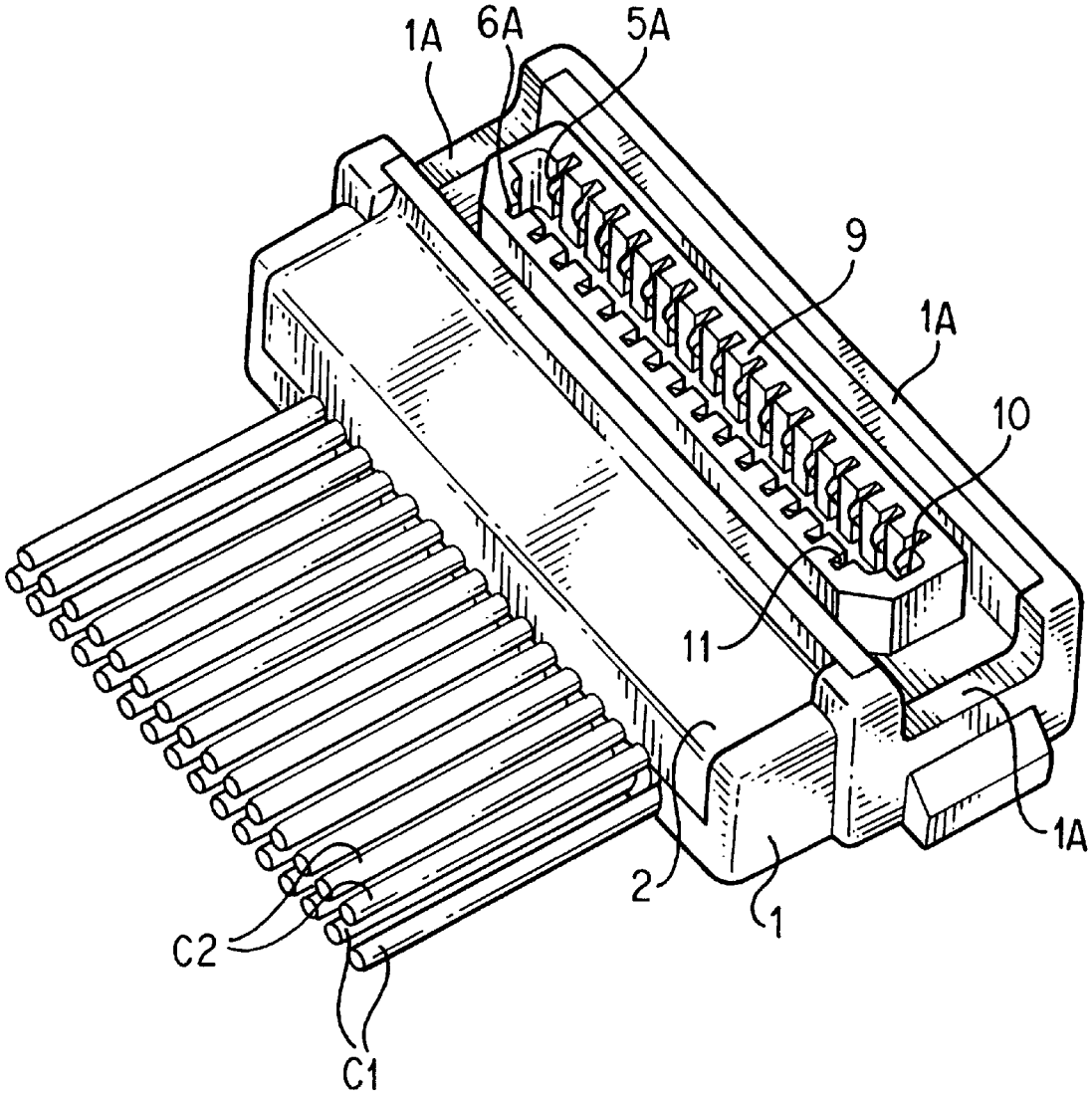
FIG. 1 is a perspective view of an electrical connector according to an embodiment of the invention.
Figure 2:
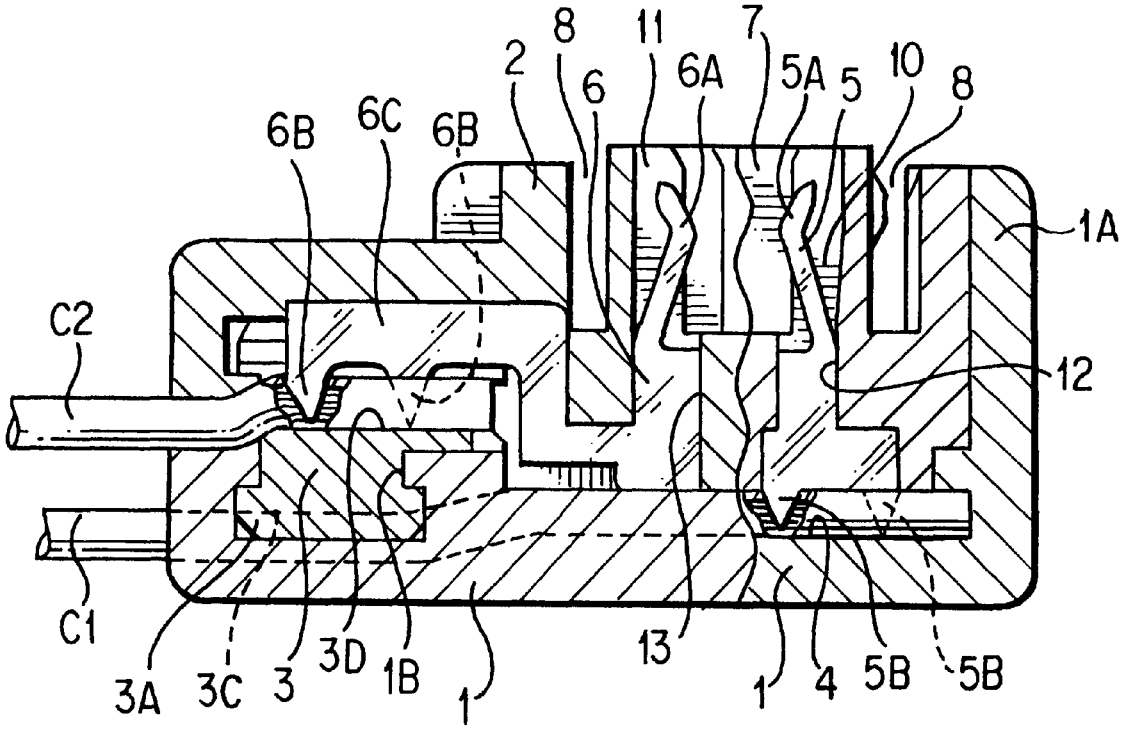
FIG. 2 is a sectional view of the connector taken in two different planes.

In FIGS. 1 and 2, a connector housing is made from an insulation material so as to have a housing body 1, a holding member 2 fitted in the housing body 1, as shown in FIG. 1, and an intermediate member 3 provided between the housing body 1 and the holding member 2 as shown in FIG. 2.

A plurality of first arranging grooves 4 are formed on the bottom of the housing body 1 for receiving a plurality of insulated conductors C1 arranged at predetermined intervals in a direction perpendicular to the sheet. The insulated conductors C1 are put into the arranging grooves 4 before the holding member 2 and the intermediate member 3 are attached.

A mounting cavity 1B is formed in the raised bottom portion of the housing body 1 for receiving a mounting section 3A of the intermediate member 3. The mounting cavity 1B and the mounting section 3A are made in such shapes that they are connected permanently by press-fitting.

A plurality of receiving grooves 3C are formed on the lower face of the intermediate member 3 for receiving upper part of the insulated conductors C1, and a plurality of second arranging grooves 3D are formed on the upper face of the intermediate member 3 for receiving a plurality of second insulated conductors C2 at predetermined intervals The second insulated conductors C2 are put into the second arranging grooves 3D before the holding member 2 is attached.

Figure 3:
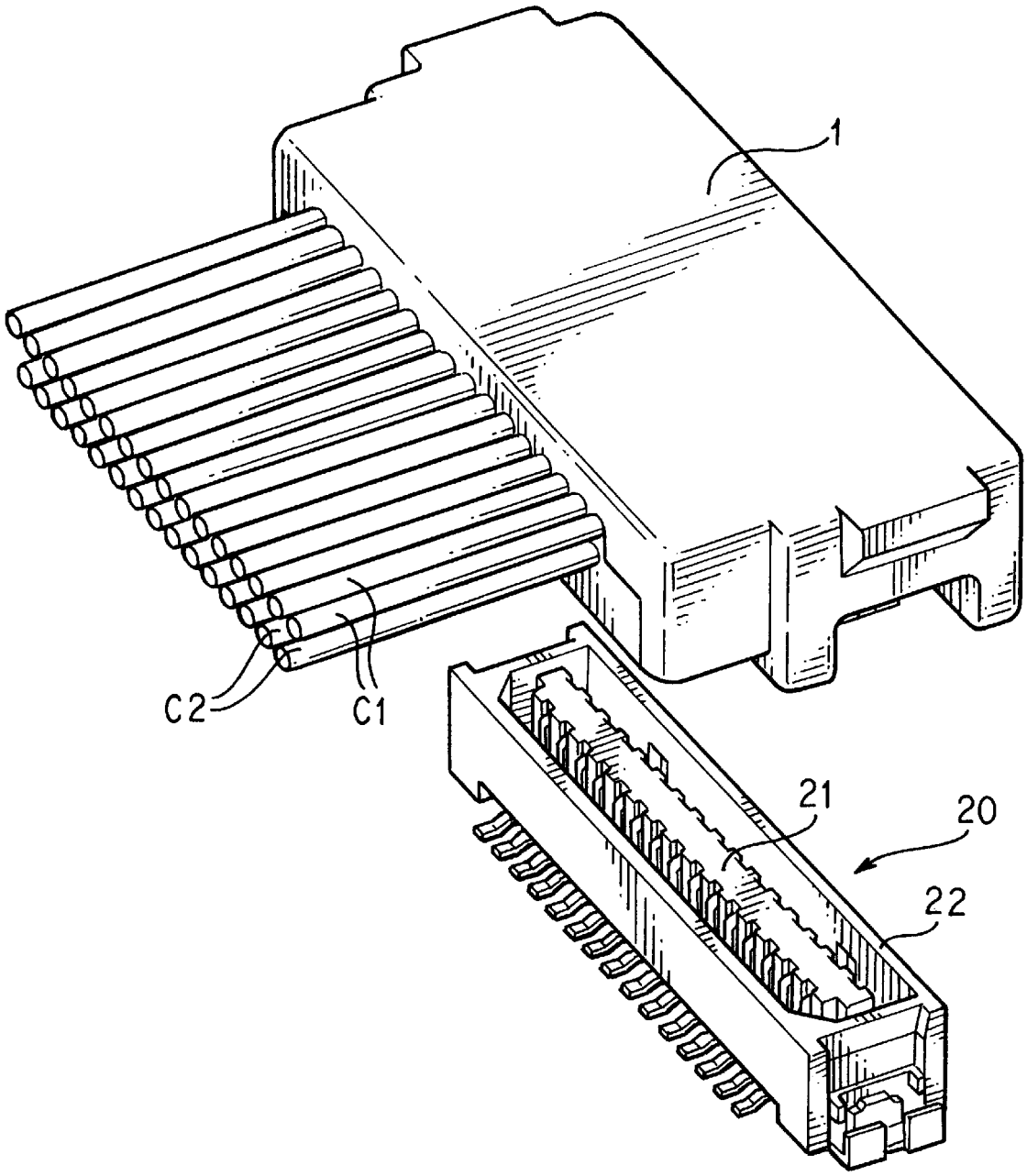
FIG. 3 is a perspective view of the connector with a mating connector.
Figure 4:
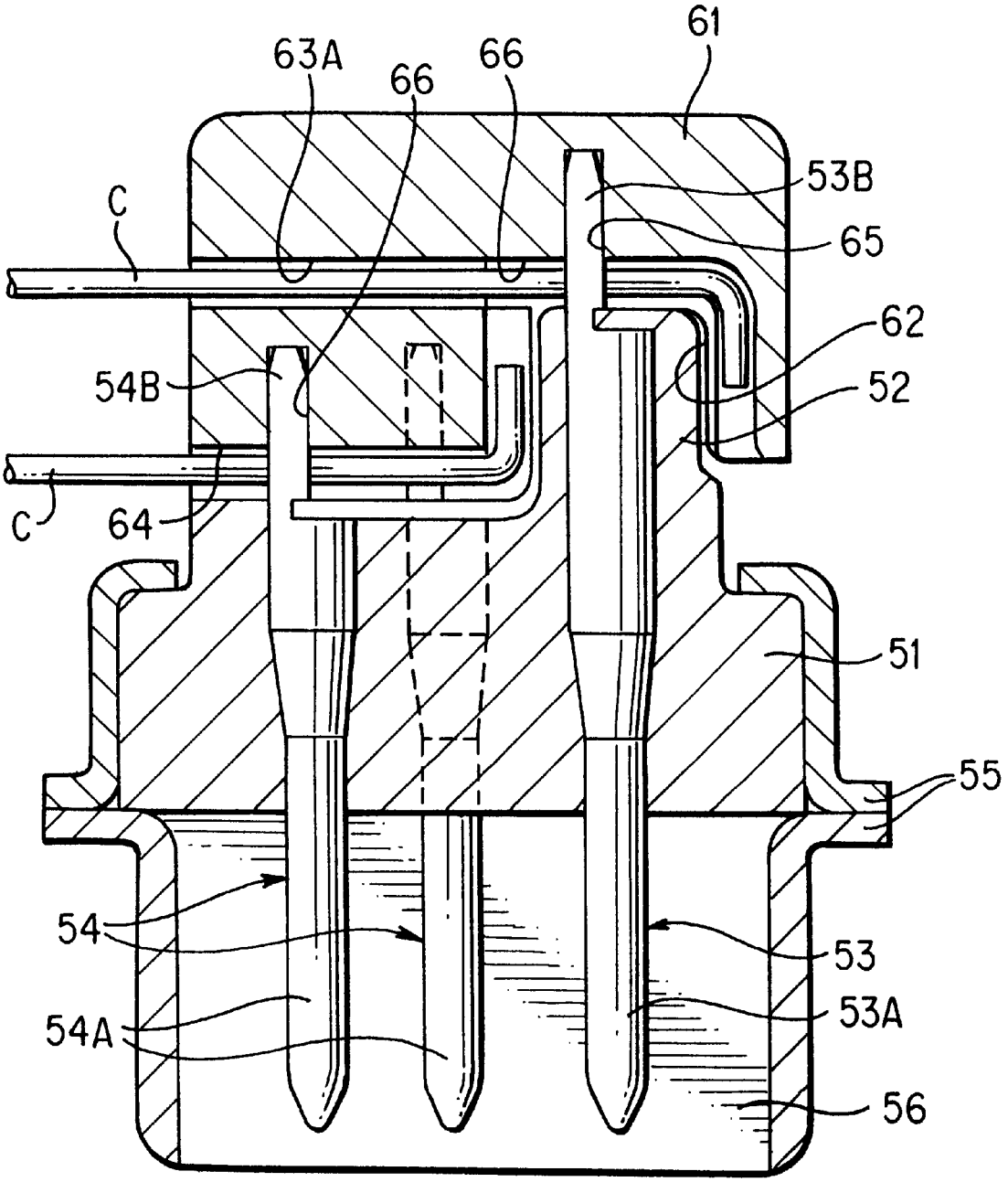
FIG. 4 PRIOR ART
FIG. 4 is a sectional view of a conventional connector.

The holding member 2 holds a plurality of first contact elements 5 and a plurality of second contact elements 6. A receiving recess 7 is formed in a raised island 9 of the holding member 2 for receiving a flat contact element assembly 21 of a mating connector 20 (FIG. 3), and a circular recess 8 is formed around the raised island 9 for receiving a peripheral wall 22 of the mating connector 20. A plurality of contact grooves 10 and 11 are formed in the receiving recess 7 for receiving contact sections 5A and 6A of the contact elements 5 and 6 arranged at the predetermined intervals. The respective contact grooves 10 and 11 have apertures 12 and 13 which extend to the lower face of the holding member 2.

The contact elements 5 in the first row are held by the apertures 12 of the holding member 2 and have connection sections 5A which are put in the contact grooves 10. Two press contact sections or teeth 5B in the form of a triangular blade are placed at such positions that they cut into the core wire of the insulated conductors C1 arranged in the first arranging grooves 4.

The contact elements 6 in the second arranging row are held by the apertures 13 of the holding member 2 and have connection sections 6A which are put in the contact grooves 11 and extension sections 6C which extend in a direction away from the first contact elements 5. The extension sections 6C extend laterally from U-shaped portions of the contact elements 6. Two press contact sections or teeth 6B in the form of a triangular blade extend downwardly from the extension sections 6C. These press contact sections 6B are placed at such positions that they cut into the core wires of the insulated conductors C2 in the second arranging row.

The electrical connector thus constructed is wired as follows.

(1) Lower tier insulated conductors C1 of a cable are put into the respective first arrangement grooves 4 of the housing body 1.

(2) The mounting section 3A of the intermediate member 3 is press fitted into the mounting cavity 1B of the housing body 1 so that the receiving grooves 3C receive the insulated conductors C1.

(3) Upper tier insulated conductors C2 of the cable are put into the second arrangement grooves 3D of the intermediate member 3.

(4) Contact elements 5 and 6 are press fitted into the apertures 12 and 13 of the holding members 2 in the first and second arrangement rows.

(5) The holding member 2 with the contact elements is pushed into the housing body 1 so that the press contact sections 5B and 6B of the contact elements 5 and 6 cut into the core wires of the conductors C1 and C2, respectively Thus, the connector is wired as shown in FIGS. 1 and 2.

(6) To connect the connector to a mating connector, the connector is turned upside down and plugged into the mating connector 20 which is mounted on a circuit board (not shown).

As has been described above, since the extension sections are provided on the middle portions of the contact elements in parallel to the second conductor row and since the press contact sections are formed on the extension sections, the distance of press contact sections between the first and second contact rows is so small that the height of the connector is small. Consequently,. another circuit board is provided at a small distance from the circuit board on which the mating connector is mounted. This makes miniaturization of equipment possible.

If receiving grooves are formed in the lower face of the intermediate member, it is possible to position the intermediate member toward the first conductor row by that much, further reducing the height of the connector.

What is claimed is:

1. An electrical connector comprising:

a housing body having a plurality of first arranging grooves for arranging a first row of insulated conductors of a cable in a plane perpendicular to a plugging direction to a mating connector;

an intermediate member having a first surface facing said first row of conductors and second arranging grooves on a second surface opposite to said first surface for arranging a second row of insulated conductors;

a holding member for holding first and second rows of contact elements and having an plug opening;

a plurality of first press connection sections extending from said first contact elements at such positions that they cut into core wires of said first row of conductors;

a plurality of connection sections extending upwardly from said first and second contact elements into said openings;

a plurality of extension sections extending from U-shaped portions of said second row of contact elements in parallel to said second row of conductors; and a plurality of second press connection sections extending downwardly from said extension sections for press connection to said second insulated conductors to thereby minimize a height of said electrical connector.

2. An electrical connector according to claim 1, wherein said housing body has a mounting cavity and said intermediate member has a mounting section to be fitted into said mounting cavity.

3. An electrical connector according to claim 2, wherein said mounting section has a plurality of receiving grooves for receiving part of said first row of conductors.

* * * * *